US005920918A

United States Patent [19]

Thomas

[11] Patent Number: 5,920,918

[45] Date of Patent: Jul. 13, 1999

[54] FLUSH TANK COVER WITH A HIDDEN STORAGE COMPARTMENT

[76] Inventor: Adam R. Thomas, 8853 State Rte. 163, Millstadt, Ill. 62260

[21] Appl. No.: 09/079,831

[22] Filed: May 15, 1998

[51] Int. Cl.[6] ..... E03D 1/01

[52] U.S. Cl. ..... 4/353; D23/313

[58] Field of Search ..... 4/353, 661; D23/313

[56] References Cited

U.S. PATENT DOCUMENTS

| | | | |
|---|---|---|---|
| D. 99,439 | 4/1936 | Lauber | D23/313 |
| D. 351,463 | 10/1994 | McCormick | D23/313 |
| 825,921 | 7/1906 | Miller . | |
| 909,965 | 1/1909 | Thompson . | |
| 1,030,059 | 6/1912 | Drugan et al. . | |
| 1,835,540 | 10/1931 | Tilden . | |
| 1,861,802 | 6/1932 | Kelly | 4/353 |
| 2,099,932 | 11/1937 | Isaacson | 4/353 |
| 2,170,776 | 8/1939 | Goepel | 4/353 |
| 2,500,463 | 3/1950 | Loche | 4/353 |
| 3,181,176 | 5/1965 | Nagy et al. . | |
| 5,073,998 | 12/1991 | Wood, Jr. et al. | 4/661 |
| 5,519,900 | 5/1996 | Gardner | 4/353 |
| 5,640,722 | 6/1997 | Bui | 4/353 |

*Primary Examiner*—Charles E. Phillips
*Attorney, Agent, or Firm*—Joseph N. Breaux

[57] ABSTRACT

A flush tank cover which is preferably constructed of wood and includes a spindle railing to prevent items placed on the flush tank cover from slipping off the back and sides of the flush tank cover and a hidden storage compartment accessible through a top mounted trap door. Preferably, the trap door is spring biased to a normally closed position.

17 Claims, 2 Drawing Sheets

FLUSH TANK COVER WITH A HIDDEN STORAGE COMPARTMENT

TECHNICAL FIELD

The present invention relates to flush tank covers and, more particularly, to a flush tank cover which is preferably constructed of wood and includes a spindle railing to prevent items placed on the flush tank cover from slipping off the back and sides of the flush tank cover and a hidden storage compartment accessible through a top mounted trap door.

BACKGROUND OF THE INVENTION

Most flush tanks are provided with tank covers to cover the reservoir of water stored in the flush tanks. Typically, such tank covers are made of the same material as the flush tanks, which is porcelain. Such porcelain flush tank covers are heavy and undecorative. Moreover, it is common to place articles on top of the flush tank covers. However, the articles oftentimes fall off of the flush tank covers because cf the lack of back and side rails. Before washing one's hands or before bathing, it is common to remove jewelry from one's body and place such jewelry on the counter of the sink in the bathroom or on top of the flush tank cover. Therefore, it is highly desirable to provide a bathroom with a hidden compartment for storing therein valuables such as, jewelry to prevent misplacement of such jewelry. Moreover, a hidden compartment is highly desirable for storing dentures, contact lenses, or other personal items. Such a hidden compartment is particularly advantageous for a bathroom which does not have a medicine cabinet. Thereby, such a hidden compartment would provide a storage compartment for the placement of articles to reduce clutter on the counter around the bathroom sink.

Several devices have been patented which are aimed at flush tank covers.

U.S. Pat. No. 3,181,176, to Nagy et al., entitled "ARTICLE RETAINING BAND FOR FLUSH TANKS" discloses a retaining guard for use on and in conjunction with a porcelain or equivalent lid or cover which is commonly used on a flush tank. The retaining guard serves to prevent miscellaneous articles from being displaced from the top surface of the cover and falling into an uncovered bowl. As shown the retaining guard is disposed in the front of the tank lid.

U.S. Pat. No. 1,835,540, to Tilden, entitled "COVER FOR FLUSH TANKS" discloses a flush tank cover adapted to operatively support one or more toilet paper rolls. The flush tank cover is provided with detachable cores or spindles upon which the roles of toilet paper are usually mounted and freely rotate. U.S. Pat. No. 1,030,059, to Schoenthaler, entitled "FLUSH TANK COVER" discloses a flush tank cover made of porcelain which has a hollow portion to reduce the dead weight of such flush tank cover.

U.S. Pat. No. 909,965, to Thompson, entitled "FLUSH TANK FOR WATER CLOSETS" discloses a wooden case having a sheet metal lining spaced apart therefrom, a corrugated member interposed between the lining and the wooden case.

U.S. Pat. No. 825,921, to Miller, entitled "TANK FOR WATER CLOSETS" discloses a casing made of veneer which is shaped to enclose the front and end walls of a reservoir-box.

U.S. Design Pat. No. Des 351, 463, to McCormick, entitled "TOILET TANK VENTILATING COVER" illustrates an ornamental design for a toilet tank ventilating cover.

While each of the above flush tank covers function as desired, none of them have a flush tank cover which is preferably constructed of wood and includes a spindle railing to prevent items placed on the flush tank cover from slipping off the back and sides of the flush tank cover and a hidden storage compartment accessible through a top mounted trap door.

SUMMARY OF THE INVENTION

The preferred embodiment of the flush tank cover of the present invention solves the aforementioned problems in a straight forward and simple manner. What is provided is a flush tank cover which is preferably constructed of wood and includes a spindle railing to prevent items placed on the flush tank cover from slipping off the back and sides of the flush tank cover and a hidden storage compartment accessible through a top mounted trap door.

The flush tank cover for on a flush tank of a toilet, of the present invention, comprises a rectangularly shaped member removably couplable to said flush tank which includes a top surface with a first outer perimeter defined by a front long side, a rear long side and first and second short sides wherein said top surface has formed therein an opening having an opening perimeter, and a continuous flange member projecting downward from an underside of said top surface continuously around said first outer perimeter; a box-shaped member coupled to said underside of said top surface around said opening perimeter; and, a trap door, hingely coupled to a wall of said box-shaped member, having a second outer perimeter which is receivable in said opening perimeter, essentially fully covers said opening and is flush with said top surface wherein said hollow box-shaped member in combination with said trap door provides a hidden storage compartment.

The flush tank cover further comprises a railing coupled to the rear long side and the first and second short sides.

In view of the above, an object of the present invention is to provide a flush tank cover which includes a hidden compartment having a top mounted trap door which is lockable via a locking mechanism. Thereby, the hidden compartment can be used to safely store therein jewelry and other valuables. Preferably, the trap door is spring biased coupled to maintain a normally closed position.

Another object of the present invention is to provide a flush tank cover having a hidden compartment which is dimensioned to store therein toilet paper. Moreover, other personal articles such as dentures, contact lenses, etc. can be placed in the hidden compartment.

A further object of the present invention is to provide a flush tank cover which is significantly lighter in weight than conventional porcelain flush tank covers.

In view of the above objects, it is a feature of the present invention to provide a flush tank cover which is decorative.

Another feature of the present invention is to provide a flush tank cover which is relatively simple structurally and easy to manufacture.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
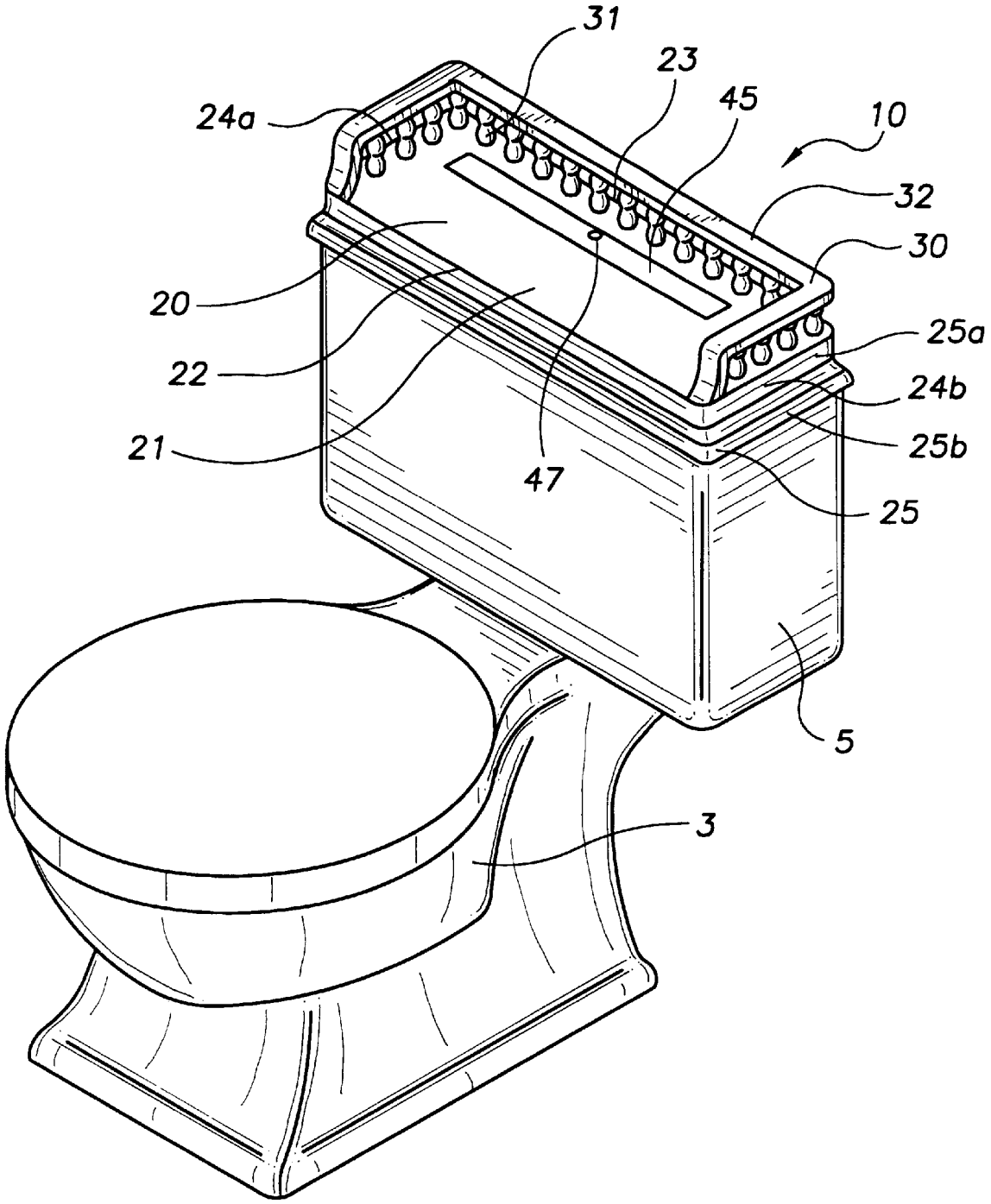
FIG. 1 illustrates a perspective view of the preferred embodiment of the flush tank cover of the present invention placed on the top of the flush tank of a toilet with the trap door in the normally closed position.
Figure 2:
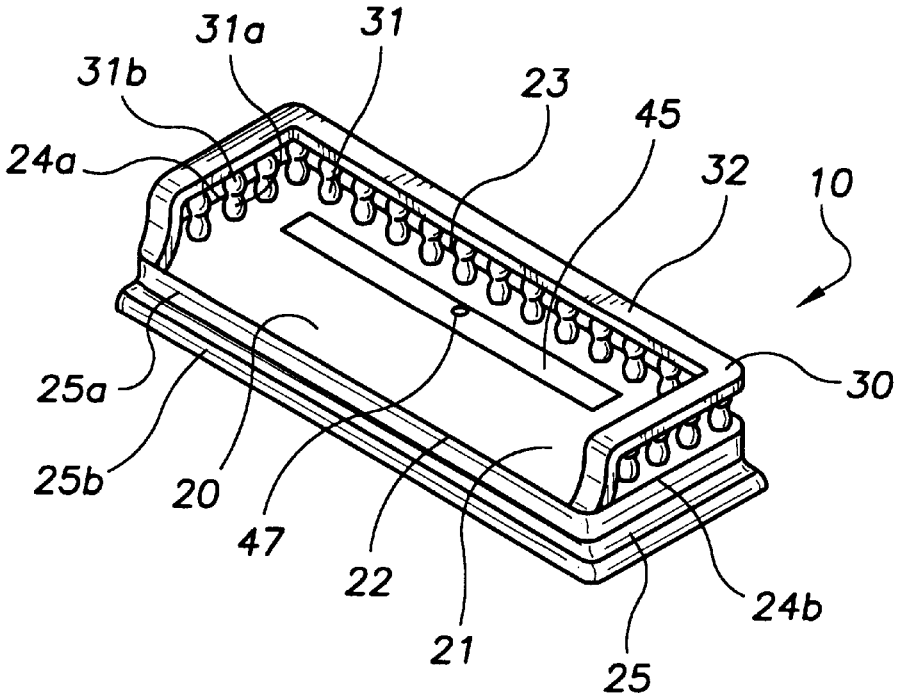
FIG. 2 illustrates a perspective view of the preferred embodiment of the flush tank cover of the embodiment of FIG. 1; and, FIG. 3 illustrates a partial view of the flush tank cover with the trap door opened.
Figure 3:
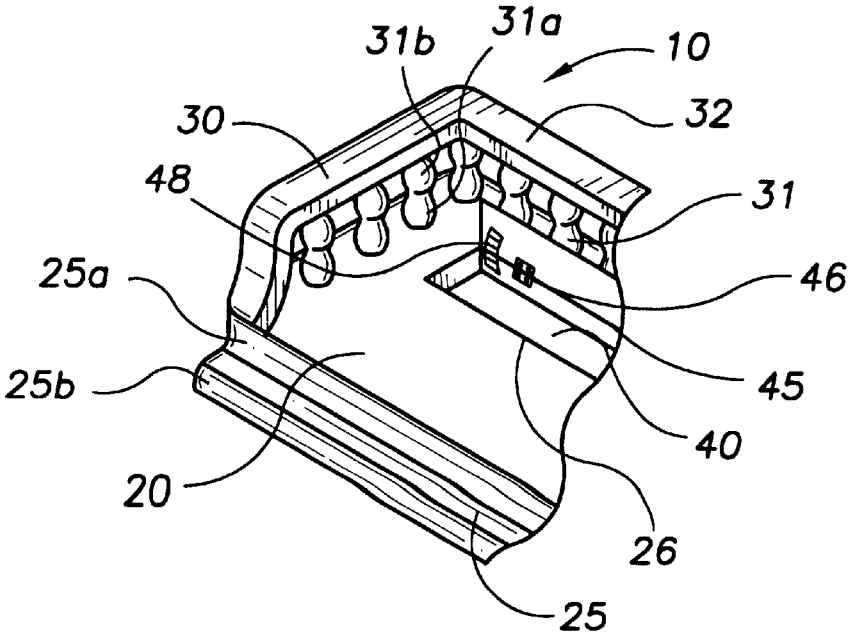

Referring now to the drawings, and in particular FIGS. 1–3, the flush tank cover of the present invention is designated generally by the numeral 10. Flush tank cover 10 is comprised of rectangularly shaped member 20, railing 30, box-shaped member 40 and trap door 45.

Rectangularly shaped member 20 includes top surface 21 with a first outer perimeter defined by front long side 22, rear long side 23 and first and second short sides 24*a* and 24*b* and continuous flange member 25 projecting downward from an underside of top surface 21 continuously around the first outer perimeter. Top surface 21 has formed therein opening 26 having an opening perimeter. As shown, opening 26 is rectangularly shaped with a narrow width. Preferably, opening 26 is disposed toward the rear of top surface 21.

Flange member 25 is removably coupled to the surface along the top of flush tank 5 of toilet 3 so as to maintain flush tank cover 10 secured to flush tank 5. Flange member 25 comprises first wall 25*a* and second wall 25*b* wherein second wall 25*b* slightly projects outward from first wall 25*a*. The construction of flange member 25 enhances the decorative appearance of flush tank cover 10.

Railing 30 is coupled to rear long side 23 and first and second short sides 24*a* and 24*b*. In the exemplary embodiment, railing 30 comprises a plurality of spaced spindles 31 having one end perpendicularly coupled in close proximity to the first outer perimeter along rear long side 23 and first and second short sides 24*a* and 24*b* and rail member 32 coupled to the other end of the plurality of spaced spindles 31. As can be appreciated, railing 30 prevents articles placed on top surface 21 from falling off the back and sides of flush tank cover 10. Nevertheless, railing 30 may also be coupled to front long side 22 to completely enclose top surface 21. In the exemplary embodiment, each spindle of the plurality of spindles 31 comprises first solid ball member 31*a* and second ball shaped member 31*b* stacked above first solid ball member 31*a*. Rail member 32 along first and second short sides 24*a* and 24*b* projects downward and couples to the front corners of top surface 21.

Referring now to FIG. 3, box-shaped member 40 is coupled to the underside of top surface 21 around the opening perimeter defined by opening 26. Box-shaped member 40 is hollow and dimensioned to allow jewelry and other valuables to be stored therein. Nevertheless, alternatively, box-shaped member may be made deeper and wider to allow toilet paper to be placed therein or other larger articles.

Trap door 45 is hingely coupled to the front wall or the rear wall of box-shaped member 40 via hinge members 46 (only one shown). Trap door 45 has an outer perimeter which is receivable in said opening perimeter to fully cover opening 26. Additionally, trap door 45 is spring biased coupled to box-shaped member 40 via spring bias members 48 (only one shown) to maintain trap door 45 in a normally closed position. Trap door 45 comprises locking mechanism 47 for locking trap door 45 when closed. As shown, trap door 45 is coupled in opening 26 so that trap door 45 is flush with top surface 21. Thereby, trap door 45 would not be readily seen.

Box-shaped member 40 in combination with trap door 45 provides a hidden compartment. Moreover, since trap door 45 is lockable via locking mechanism 47 valuables may be secured in such hidden compartment. The hidden compartment is particularly advantageous since it is very common to take jewelry off before washing one's hands or before bathing. Thereby, the hidden compartment provides a secured chamber which is readily available in the bathroom for the placement of valuables. Moreover, other personal articles such as dentures, contact lenses, etc. can be placed in the hidden compartment. As can be appreciated, the hidden compartment provides a storage compartment to reduce clutter on the counter around the bathroom sink.

In the preferred embodiment, flush tank cover 10 is made of wood such as, without limitation, oak. The use of wood in lieu of porcelain significantly reduces -the weight of flush tank cover 10 so that flush tank cover 10 can be easily lifted from and replaced on the top of flush tank 5 of toilet 3. Moreover, the use of wood to construct flush tank cover 10 significantly reduces the risk of breakage if flush tank cover 10 is dropped when removed from flush tank 5. Nevertheless, flush tank cover 10 may be made of another material which is preferably lightweight.

Articles may be placed on top surface 21 to further camouflage trap door 45 so that trap door 45 is not readily seen.

It is noted that the embodiment of the flush tank cover described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A flush tank cover for on a flush tank of a toilet comprising:

a rectangularly shaped member removably couplable to said flush tank wherein said rectangularly shaped member comprises:

a top surface with a first outer perimeter defined by a front long side, a rear long side and first and second short sides wherein said top surface has formed therein an opening having an opening perimeter, and a continuous flange member projecting downward from an underside of said top surface continuously around said first outer perimeter;

a hollow box-shaped member coupled to said underside of said top surface around said opening perimeter; and, a trap door, hingely coupled to a wall of said box-shaped member, having a second outer perimeter which is receivable in said opening perimeter, essentially fully covers said opening and is flush with said top surface wherein said hollow box-shaped member in combination with said trap door provides a hidden storage compartment.

2. The flush tank cover of claim 1, further comprising: a railing coupled to said rear long side and said first and second short sides.

3. The flush tank cover of claim 2, wherein said railing comprises:

a plurality of spaced spindles having one end perpendicularly coupled in close proximity to said first outer perimeter along said rear long side and said first and second short sides; and, a rail member coupled to the other end of said plurality of spaced spindles.

4. The flush tank cover of claim 2, wherein said rectangularly shaped member, said railing, said trap door and said hollow box-shaped member are made of wood.

5. The flush tank cover of claim 4, wherein said wood is oak.

6. The flush tank cover of claim 1, wherein said trap door comprises a means for locking said trap door.

7. The flush tank cover of claim 1, wherein said trap door is spring biased coupled to said hollow box-shaped member via spring bias members to maintain a normally closed position.

8. The flush tank cover of claim 1, wherein said flange member comprises a first wall and a second wall wherein second wall slightly projects outward from said first wall.

9. The flush tank cover of claim 1, wherein said rectangularly shaped member, said railing, said trap door and said hollow box-shaped member are made of a lightweight material.

10. A flush tank cover for on a flush tank of a toilet comprising:

a rectangularly shaped member removably couplable to said flush tank wherein said rectangularly shaped member comprises:

a top surface with a first outer perimeter defined by a front long side, a rear long side and first and second short sides wherein said top surface has formed therein an opening having an opening perimeter, and a continuous flange member projecting downward from an underside of said top surface continuously around said first outer perimeter;

a box-shaped member coupled to said underside of said top surface around said opening perimeter;

a trap door, hingely coupled to a wall of said box-shaped member, having a second outer perimeter which is receivable in said opening perimeter and which essentially fully covers said opening wherein said hollow box-shaped member in combination with said trap door provides a storage compartment; and, a railing coupled to said rear long side and said first and second short sides.

11. The flush tank cover of claim 10, wherein said railing comprises:

a plurality of spaced spindles having one end perpendicularly coupled in close proximity to said first outer perimeter along said rear long side and said first and second short sides; and, a rail member coupled to the other end of said plurality of spaced spindles.

12. The flush tank cover of claim 10, wherein said rectangularly shaped member, said railing, said trap door and said box-shaped member are made of wood.

13. The flush tank cover of claim 12, wherein said wood is oak.

14. The flush tank cover of claim 10, wherein said trap door comprises a means for locking said trap door.

15. The flush tank cover of claim 10, wherein said trap door is spring biased coupled to said box-shaped member via spring bias members to maintain a normally closed position.

16. The flush tank cover, of claim 10, wherein said flange member comprises a first wall and a second wall wherein second wall slightly projects outward from said first wall.

17. The flush tank cover of claim 10, wherein said rectangularly shaped member, said railing, said trap door and said box-shaped member are made of a lightweight material.

* * * * *